United States Patent [19]

Miller et al.

[11] 4,127,014

[45] Nov. 28, 1978

[54] APPARATUS FOR DYEING PILE FABRIC WEBS

[75] Inventors: James D. Miller; Buddy A. Sewell, both of Dalton, Ga.

[73] Assignee: Shaw Industries, Inc., Dalton, Ga.

[21] Appl. No.: 802,583

[22] Filed: Jun. 1, 1977

[51] Int. Cl.[2] ..... D06B 1/06; D06B 11/00

[52] U.S. Cl. ..... 68/13 R; 68/205 R; 118/325

[58] Field of Search ..... 68/200, 205 R, 13 R; 118/315, 325

[56] References Cited

U.S. PATENT DOCUMENTS

| | | | |
|---|---|---|---|
| 3,731,503 | 5/1973 | Appenzeller et al. | 68/205 R |
| 4,010,709 | 3/1977 | Sayman et al. | 68/205 R X |

FOREIGN PATENT DOCUMENTS

| | | | |
|---|---|---|---|
| 1,296,725 | 11/1972 | United Kingdom | 68/205 R |
| 1,363,724 | 8/1974 | United Kingdom | 118/325 |

*Primary Examiner*—Philip R. Coe
*Attorney, Agent, or Firm*—Fleit & Jacobson

[57] ABSTRACT

An improved method and apparatus for dyeing a pile fabric web to produce very novel and distinctive multicolored designs is disclosed. In the practice of the invention a plurality of dyes are applied to a moving pile fabric web with each color or dye being applied as separate, individual streams at varying points along a line traverse of the moving web. The apparatus comprises a pair of identical, opposed dye applicators mounted above a moving web with each applicator unit including a dye holding tray; a dye pickup roll mounted within the tray; a doctor blade mounted adjacent the pickup roll for removing a layer of dye from the roll; a plurality of channels mounted on, or formed integral with, the doctor blade and which divide the dye into separate streams or drippings, each of said channels having a discharge zone for discharging the separate dye streams or drippings; plug means for blocking the flow of dye through preselected ones of said channels whereby preselected streams of dye are blocked from the discharge zone; and means mounted immediately above each of said channels for selectively dispersing a further dye or dyes at points adjacent the discharge zones of the channels which are blocked out by the plug means. In this manner, a plurality of dye streams are applied to the moving web at separate points along an area or a line transverse of the moving web. The apparatus further includes interruptor elements mounted below the discharge zone of the channels to interrupt the continuous flow of the separate dye streams or drippings.

6 Claims, 5 Drawing Figures

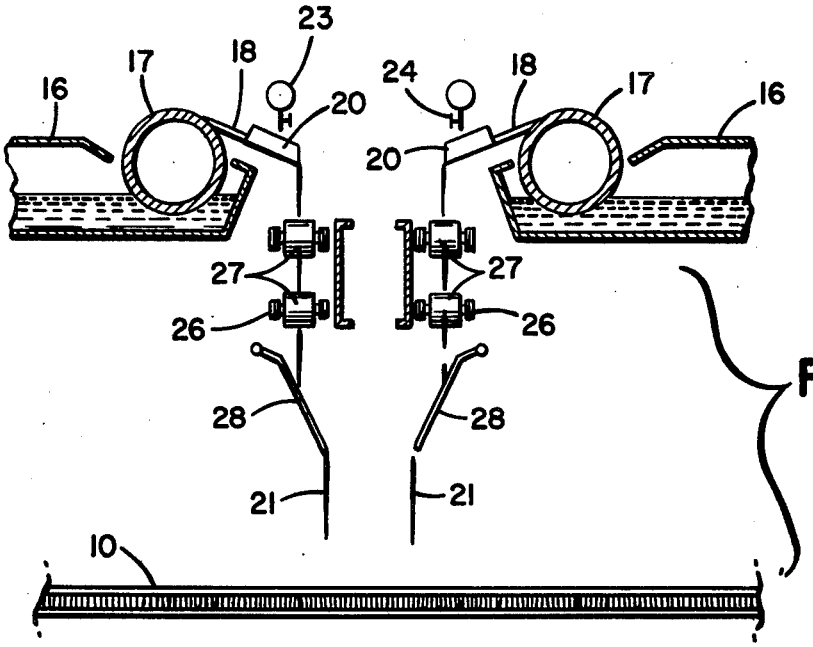
FIG. 2
FIG. 5
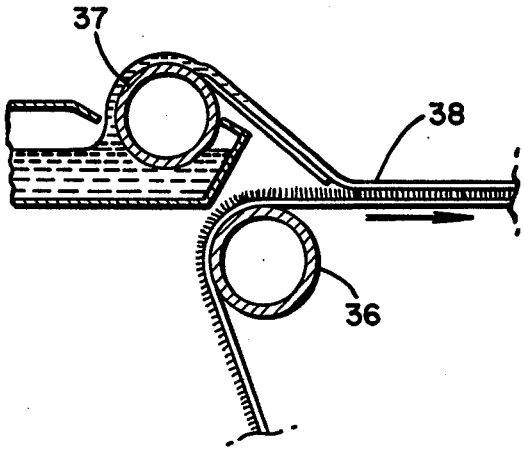

40
41
41
42
3
44
15
17
23
23
17
28
28
14
31
30
32
33
34
35
36
37

APPARATUS FOR DYEING PILE FABRIC WEBS

BACKGROUND OF THE INVENTION

1. Field of the Invention

The present invention relates to the dyeing of pile materials and, more particularly, to a new and improved method and apparatus for dyeing a pile fabric to produce novel and distinctive multi-colored designs and effects.

2. The Prior Art

In the carpet industry, prior art workers have expended, and continue to expend, much time and effort to create different and original color patterns in pile materials, carpets and rugs. Clearly the styling of carpets is of paramount importance and a principal and ever present challange of this industry.

In attempting to obtain and create various stylings and effects, numerous techniques and apparatus have been proposed. For example, the styling of the carpet has been achieved by varying the pile height. Multi-colored and repetitive geometric or floral designs have also been produced by printing the carpet in varying ways as by silk screen printing techniques.

In recent years, significant efforts have been made to create varying and non-repetitive color patterns in carpets which are thought to be different from conventional or routine patterns and which have the appeal of originality. To obtain such styling effects, drip or splatter dyeing techniques and apparatus have been proposed and developed whereby dyes of two different colors are applied to the carpet in a continuously varying and/or non-repetitive pattern. In accordance with one such procedure, commonly known in the art as "TAK" dyeing, the carpet to be dyed is transported to a dye application station or unit mounted above the carpet. As the carpet is moved under the dye applicator, dye is dripped or splattered onto the free yarn. In this type of dyeing apparatus, the dye is caused to be delivered to the carpet from a doctor blade that includes a number of individual channels for dividing the dye into a plurality of separate dye streams. The dye streams, as they issue from the doctor blade, are caused to be broken up into smaller streams or drippings by dye stream interrupter elements or means mounted adjacent to the doctor blade.

Notwithstanding all of the above known techniques, the challenge of producing new and improved designs and effects in pile carpets is always present and the demand thereof, ever increasing. The present invention provides a remarkable and commercially significant solution to this problem.

SUMMARY OF THE INVENTION

In summary, the present invention relates to production of pile fabrics or carpets having unusual multicolored patterns or effects. In its broadest aspect, the invention is an improvement over the above discussed "TAK" dyeing apparatus and provides means whereby a plurality of colors or dyes may be applied simultaneously to the face of the pile web to produce the aforesaid novel and distinctive multicolored effects. In the practice of the invention, and again broadly speaking for a moment, the carpet is transported under a dye application station which comprises a pair of opposing, duplicate dye applicators. Each applicator comprises a dye holding tray and a dye pickup roll rotatably mounted within the tray. A doctor blade is positioned adjacent to the pickup roll for removing the film or layer of dye from the roll. Channel means are mounted onto and form extensions of the doctor blade with the end of each channel having a distinct discharge point for releasing the dye as a separate dye stream. The channels include adjustable blocking plugs or wedges to stop the flow of the dye for that particular channel. This allows the flow of dye from the channels to be regulated on an individual basis, i.e., the channels can be plugged or left open in varying arrangements. In accordance with the invention, means are mounted immediately adjacent the channels, for depositing, e.g., a different dye or color into a channel which has been plugged or blocked off. In this manner, a plurality of dye streams can be delivered onto the pile face at substantially the same area of contact relative to a line or plane transverse of a moving web. Dye stream interrupter elements are mounted immediately below or adjacent the channels to break-up the streams of dyes issuing from each channel.

From the above brief description, it will be seen that the present invention provides a remarkable, straight forward, yet highly efficient system for applying a number of different colors or dyes to a moving pile web. As will be discussed hereafter, while particularly unique patterns or designs are achieved by the use of four separate colors or dyes, separate streams of a dye of the same color but different shades thereof, or many combinations of the foregoing, may also be used to produce distinctive results. Combinations include, e.g., three dyes of three separate colors with one dye of the same color but varying shades thereof etc. In fact, and as will be appreciated by those skilled in this art, it is possible to produce an almost unlimited number of multicolored variations by the practice of the invention.

It is accordingly a general object of the present invention to create novel pile carpets and rugs having unusual multicolored designs and effects.

A further and more particular object is to provide an improved apparatus for applying separate dyes or colors to a pile fabric or web to produce novel and very distinctive multicolored designs and effects.

Yet another object is to provide a novel apparatus for applying a plurality of dyes to a pile carpet or web.

BRIEF DESCRIPTION OF THE DRAWINGS

The manner in which the foregoing and other objects are achieved in accordance with the present invention will be better understood in view of the following detailed description and accompanying drawings, wherein:

FIG. 2 is a cross-sectional view on an enlarged scale of the splatter dye applicator of the present invention;

FIG. 5 is an enlarged fragmentary vertical section taken through a viscous gum coating unit employed in the apparatus embodiment of FIG. 4.

DETAILED DESCRIPTION OF THE PREFERRED EMBODIMENT(S)

Figure 1:
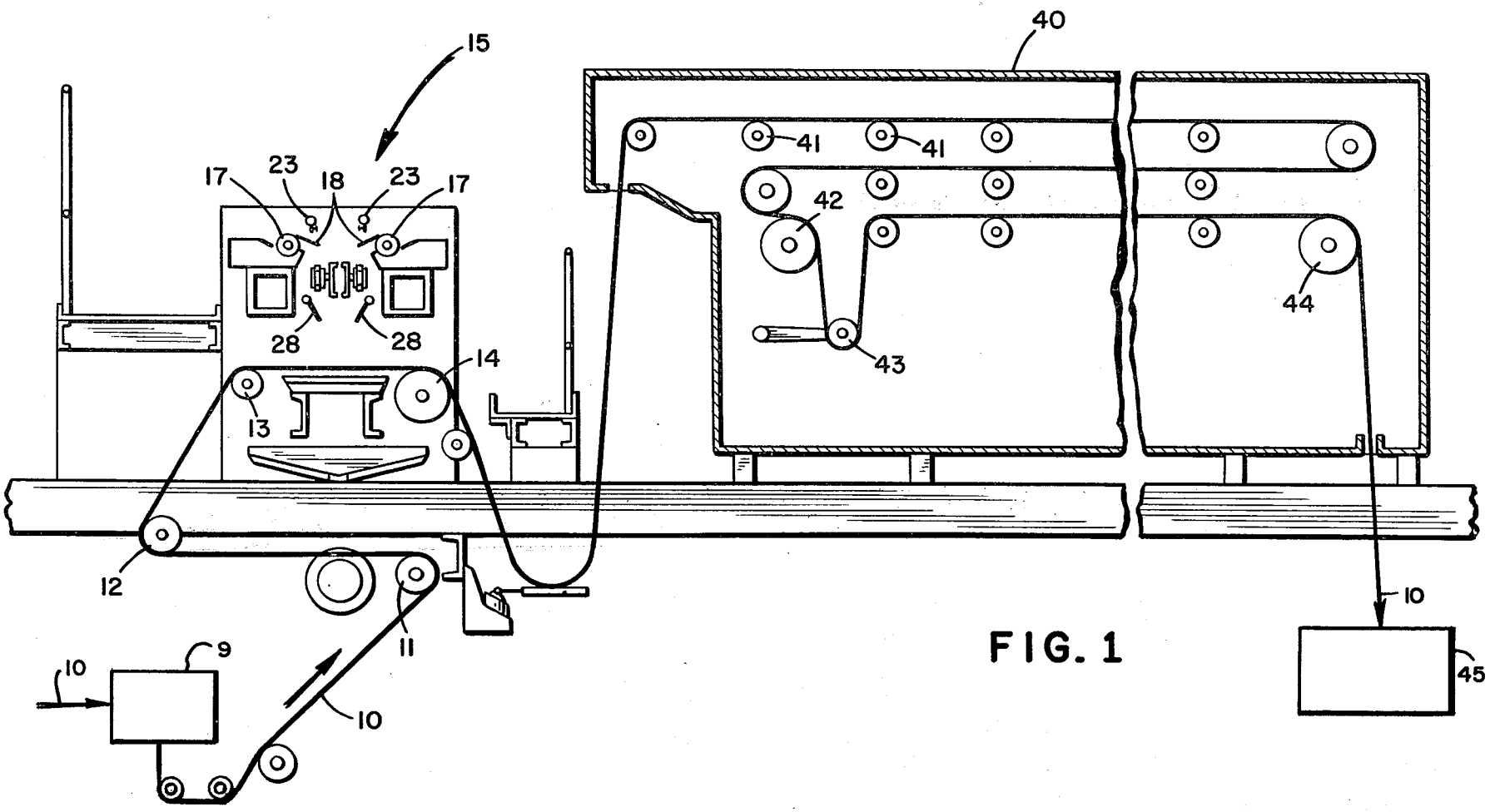
FIG. 1 is a schematic side elevational view of a carpet dyeing apparatus which comprises a first apparatus embodiment of the present invention.

With reference now to the drawings and first to FIGS. 1 and 2, there is shown a particular suitable arrangement of apparatus for carrying out a first embodiment of the present invention. As shown in FIG. 1, a pile fabric web 10, such as a tufted carpet web, is advanced in the direction of the arrow over a series of rolls 11, 12 and 13 by a main powered pin roller 14 at a dye application unit or station indicated generally at 15. As known in the art and being taught, e.g., in U.S. Pat. No. 4,010,709, the tufted carpet web may be first passed into a dyeing unit 9 wherein a background color is imparted to the carpet pile prior to the carpet being dyed in accordance with the teachings of the present invention. As best shown in FIG. 2, the dye applicator unit 15 comprises a pair of opposed, identical applicators, each applicator including a dye tray 16 which contains a dye in liquid form. This dye is preferably of a syrupy consistency and may, as described in more detail hereinafter, comprise any typical dye composition chosen from commercially available dyes that are compatible with the various natural or synthetic fibers to be dyed. Each applicator further includes a dye pickup roll 17 for delivering a uniform film or layer of the liquid dye to a coacting doctor blade 18.

Figure 3:
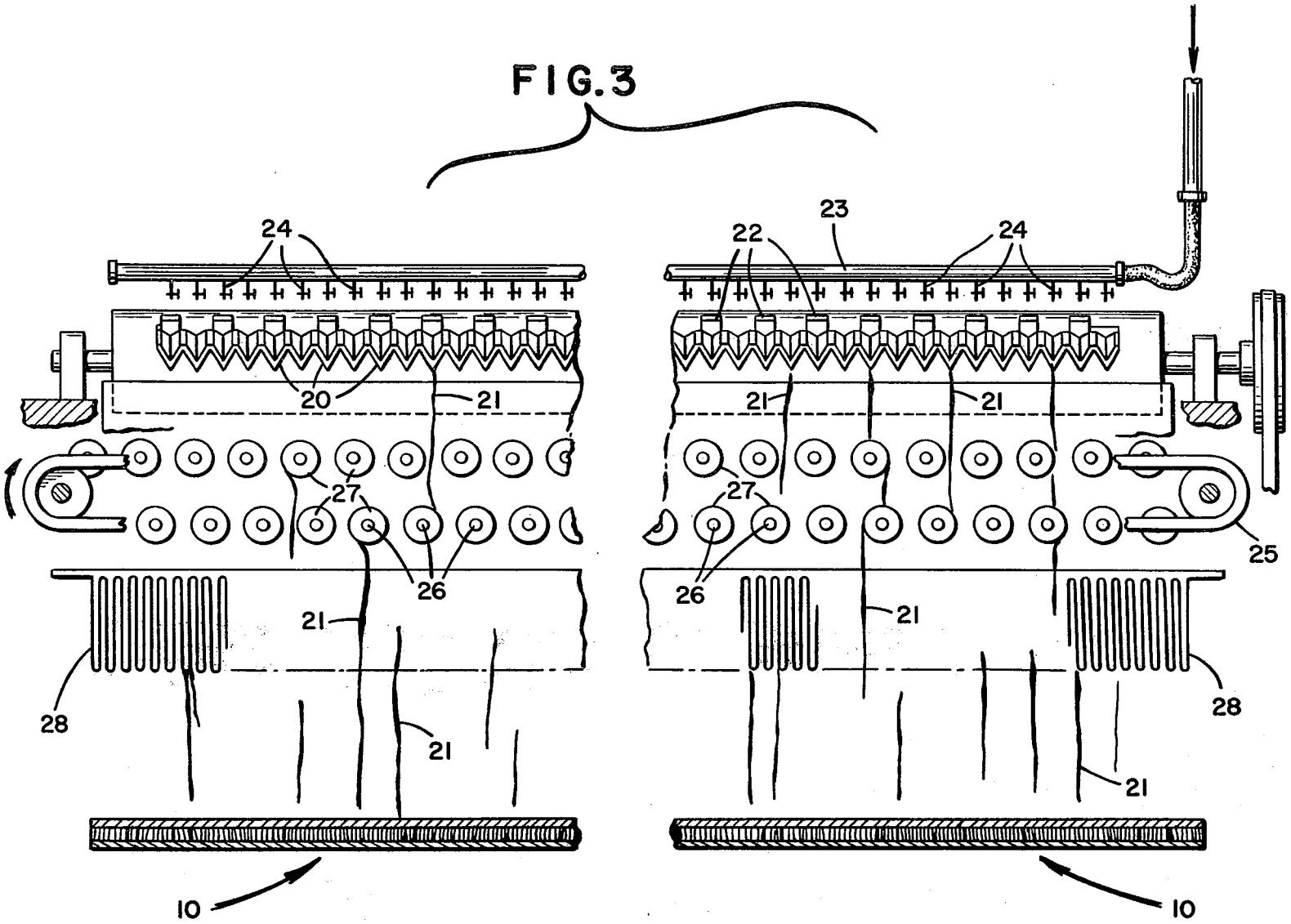
FIG. 3 is a transverse vertical section taken on line 2—2 of FIG. 2.

With reference now to FIGS. 2 and 3, each doctor blade includes a multiplicity of channels or extensions 20 which divide the dye into multiple separate streams or drippings, generally indicated at 21. The extensions or channels 20 are provided with flow control plugs 22 so that the flow from any preselected channel or channels may be regulated or stopped altogether, depending upon the particular color pattern that has been predetermined or selected for the carpet. In the preferred embodiment shown in FIG. 3, the channels 20 are generally V-shaped in cross-sections. However, any design may be employed so long as each channel has a distinct discharge point for forming a separate dye stream with each discharge point forming a line or pattern tranverse to the moving web.

With reference to FIGS. 2 and 3, a conduit indicated at 23 is mounted immediately adjacent, and parallel with, the discharge points of the channels, this conduit further including a series or plurality of valves 24. Each valve is mounted immediately adjacent each of the individual channels 20 such that the flow from any valve, that is in an open position, flows into the corresponding channel.

In the embodiment shown in the drawing, only a single conduit 23 is illustrated. However, it should be apparent to those skilled in the art that two or more conduits may be provided. If, e.g., a second or third conduit is employed, the valve 24 would include extensions, such as flexible tubes or conduits, so that the dye or color issuing from each valve would flow into the corresponding channel 20. A truly remarkable aspect of the present invention lies in the almost umlimited number of patterns or designs that can be obtained in the practice of the invention. For example, two separate colors may be introduced into a single channel (to form or create a new single color or shade of several colors, etc.). This can be established by introducing a dye from a valve 24 into a channel that is not plugged or by the use of two or more conduit means 23, etc. The point is that the present invention provides an apparatus wherein any number of predetermined colored patterns or designs can be produced by a simple adjustment of control valves or the like.

In the practice of the invention, dye stream interruptor elements are provided immediately adjacent and below the ends or discharge points of the channels 20. In the embodiments shown in FIGS. 2 and 3, a conveyor element 25, such as a sprocket chain, carries evenly spaced stream cutters or interrupters which are composed of wire fingers or loops 26. Cyclindrical sleeves 27 are slipped over these wire fingers at regularly spaced intervals for further breaking up the dye drippings or streams issuing from the tips of the channels 20. The stream cutters or interrupters travel continuously beneath the channels in a direction transverse of, or lateral to, the line of movement of the carpet web 10. Thus, the moving elements travel through the falling dye streams and cut or interrupt these streams so that the drip pattern of the liquid dye is irregular and spread across the pile face 10 of the moving carpet web.

As shown in FIGS. 2 and 3, stationary inclined combs 28, positioned below the stream interrupters 26, 27 further intercept and break up the falling dye streams, again for the purposes of rendering the drip or splatter dye pattern random and nonuniform on the face of the carpet pile. If desired, the comb elements 28 may be pivotally mounted so that they can be simply flipped outwardly from their active positions, as shown in FIG. 2 to an inactive position clear of the falling stream.

In addition to the above, means are provided for causing the doctor blade 18, as well as the conduit 23, to oscillate transversely of the carpet. In this regard, the conduit 23 is preferably mounted by suitable brackets (not shown) directly onto the doctor blade, or the supports thereof, so that each is caused to be oscillated together and along the same path transversely of the moving web 10. In the alternative, only the doctor blade may be oscillated with means, such as flexible tubes or conduits, being affixed to the discharge outlet of each valve 24 with the opposing ends of the flexible tubes being mounted to the corresponding channel or extension 20. Further, embodiments may of course be employed with the concept here being that the ends of the conduits 20 from which the colors or dye flow, are caused to be moved or oscillated in a direction transverse or lateral to the moving web.

It should be apparent that the gist of the present invention lies in the method and apparatus for applying the individual dye streams to the moving web. Thus, the particular pile or web being treated may vary widely including, e.g., woven or knitted fabrics, or other kinds of fabricated materials known in the art.

The pile face of the fabric is also selected from materials known in the art and may include substantially any type of continuous filament or fiber. For example, these may comprise synthetic or man-made continuous filaments or spun fibers, such as polyamides in their various forms, i.e., nylon 501, etc., polyolefins, acrylics, polyesters, rayon, etc. Natural fibers such as cotton, wool, etc., may also be used. The pile face may be cut or uncut loop. It may be shag or plush, or any one of the known forms presently available. The height or depth of the pile face may vary within relatively wide limits.

The specific nature and type of the dye or coloring material which is applied to the pile face also does not embody the gist of the invention and its selection is determined by the type and nature of the filaments or fibers which are used in the pile face; the purpose of the pile carpet; the result or effect to be obtained, etc. As known in the art, acceptable dyes for use with cellulosic fibers include vat dyes, sulfur dyes, azoic dyes, reactive dyes, etc. Dyes for polyamide nylon fibers include acid dyes, premetalized dyes, disperse dyes, direct dyes, reactive dyes, ietc. Dyes for wool are vat dyes, reactive dyes, acid dyes, direct dyes, etc. These dyes are conventional and are known in the art. Examples of typical dyes are: Yellow S.L., Red G and Blue 2G.A.

Further dyes include the Irgalons of Ciba Geigy such as Yellow D.R.L., Black B.G.L., Red 2G.L., etc; the Resolin dyes manufactured by Verona such as Blue F.B.L., Red F.B., Yellow 4 G.L., etc.; the Nylosan dyes manufactured by Sandoz such as Blue 2A.L., Red E2GN, Yellow E.L., etc.; the Stylacyl dyes manufactured by DuPont such as Red R.B., Red. R.Y., Blue R.P., Yellow R.G.; the Merpacyl dyes manufactured by DuPont such as Yellow S.L., Yellow 9G., Red B, Red G, Blue 2G.A., Blue S.W., etc.; the Sevron dyes manufactured by DuPont such as Red. L, Yellow 3R.L., Yellow 8GMF, Blue A.C.N., etc., and any such dyes suitable for the fiber being dyed.

In the practice of the invention, the fluidity or viscosity of these dyes is preferrably adjusted by the addition of an aqueous media or a viscosity control agent or thickener, such as Syngum D-47-D, gum guar, gum karaya, Halltex KRS-H, etc. A few typical dye formulations are:

(1) Yellow RGLL: 60 grams per 20 Liters
(2) Red F4BLL: 4.5 grams per 20 Liters
(3) Blue BRL: 3.0 grams per 20 Liters These dye formulations are mixed with the Syngum D-47-D, 0.5 grams per liter, at a pH of about 3.0.

As should also be appreciated by those skilled in the art, the precise apparatus, including, e.g., the means for conveying the pile web prior to the application of the dye as well as the means for fixing the dye (typically a steamer) and washing the dyed fabric, is not critical to the practice of the present invention.

In this regard, however, the present invention is particularly suitable for use in combination with the teachings of U.S. patent applications Ser. No. 653,191, now allowed, and U.S. Ser. No. 653,211, now U.S. Pat. No. 4,010,709.

In summary, the disclosures of the above-noted patent applications relate to the production of a non-repetitive color pattern in pile fabrics wherein the traveling web is coated, prior to the application of the dye, with a thick viscous water-soluble barrier or layer. This layer is applied evenly over the entire pile face of the web. Thereafter, the liquid dye is dripped onto the viscous coating or layer. The viscous coating, which may comprise a natural or synthetic gum including, for example, gums, resins, colloidal polysaccharide substance, starch, etc., serves to resist the initial penetration of the dye into the pile. The dye drippings form numerous small pools and/or rivulents of varying shapes or designs on the viscous coatings.

Figure 4:
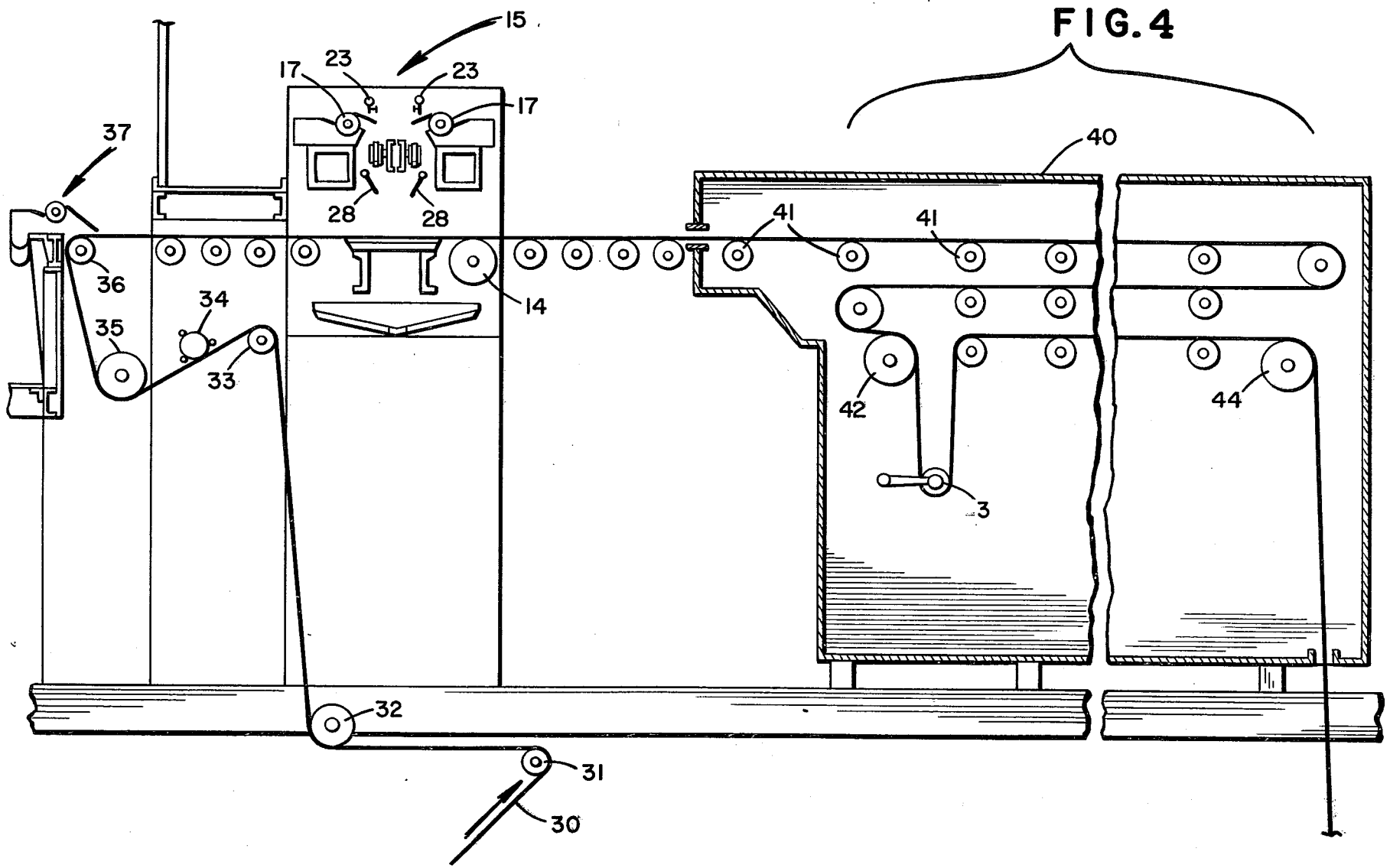
FIG. 4 is a schematic side elevation view of a further arrangement of apparatus which may be used in accordance with the present invention.

In this regard, FIG. 4 illustrates a suitable arrangement of the apparatus that may be employed in the present invention and which embodies the concept of applying the aforesaid thick viscous coating or layer onto the moving web prior to the application of the dye. With reference to FIG. 4, a pile web 30, such as a tufted carpet, is advanced in the direction of the arrow or a series of guide rolls 31, 32, and 33 and into a back beater roll 34 which loosens and straightens the carpet prior to the application of a viscous gum shield. After passing, the roll 34, the carpet or web passes around a power-driven pin roll 35 and engages a leveling roll 36 from which the web 30 moves forward in a horizontal plane as shown in FIG. 2.

As disclosed in detail in the aforenoted U.S. patent applications Ser. Nos. 653,191 and 653,211, an applicator 37, shown in an enlarged view in FIG. 5, is mounted adjacent the leveling roll 36 for applying a thick viscous coating or shield 38, of a chemically inert water soluble natural or synthetic gum, continuously and uniformly over the entire pile face of carpet web. In a particularly advantageous embodiment, the coating 38 is such that it has a viscosity on the order of from between about 1000 to 10,000 cps and preferably from between about 3000 to 5000 CPS. Viscosities from between about 1000 to 10,000 have been successfully employed to obtain very distinct and different color effects although other viscosities may be successfully used. Examples of coating materials include the aforesaid natural or synthetic water-soluble gums which are employed in this industry as thickening agents for dyes. A specific example includes SYNGUM D-47-D produced by Stein Hall Company. The viscous coating preferably has a thickness on the order of about ⅛ inch.

As shown in FIG. 4, the dye application station is mounted above the elevation of the carpet web and immediately downstream from the leveling roll and the viscous coating applicator. The dye applicators are identical to that shown in FIGS. 1, 2 and 3, discussed in detail hereinabove. For convenience, like reference numerals have been used for identical components in FIGS. 1–4.

Following the application of the dye, either directly onto the pile face or onto the thick viscous shield, as in the case of the embodiment shown in FIG. 4, the carpet or web is passed directly toward and into a steamer indicated generally at 40. If the viscous gum shield or coating is applied to the carpet prior to the application of the dye, it has its viscosity quickly reduced in the steamer such that it disintegrates and settles into the carpet pile with the dye upon it. The steamer 40 includes horizontal rows of idler support rolls 41 for the top run of the carpet web 10, 30 and several underlying runs traveling in opposite directions through the steamer and towards the steamer outlet from which the web passes to a conventional washer and dryer means (not shown). Within the steamer, the carpet web is driven by powered pin roll 42 and an associated compensating roll 43 upstream from a final driven pin roll 44 which regulates the speed of the later. Conventional electric motor control means (not shown) are employed to coordinate the driving speed of the main roll 14 and pin roll 42 to maintain tension at all times on the moving carpet web.

As briefly noted above, the heated environment of the steamer 40 causes the fixing of the dyes in the carpet pile fabric. In the embodiment shown in FIG. 4, the steamer serves a dual function, namely the fixing of the dye while simultaneously causing the melting or disintegration of the viscous coating and the resulting settlement thereof. When the viscous coating is applied, it forms a temporary barrier to the penetration or settlement of the liquid dye into the carpet pile. While this barrier action is taking place, the pooling dye on top of the barrier is forming the ultimate pattern for the dye in the carpet pile after the disintegration of the viscous coating. The color patterns obtainable by the instant invention are almost limitless when the aforesaid viscous shield is applied and very delicate in their blending and halo effects. After emerging from the steamer 40, the carpet may be passed through a wash box 45 to remove any excess dye and/or gum coating. Such wash apparatus is well known in the art and disclosed for example in the aforenoted U.S. Pat. No. 4,010,709.

While various embodiments of the invention have been set forth hereinabove, it should be understood that same have been disclosed for illustrative purposes and that various modifications of the apparatus of the invention may be made without departing from the spirit of the invention or scope of the appended claims.

What is claimed is:

1. An apparatus for applying a plurality of colors to a pile fabric web, said apparatus comprising means for transporting a pile fabric web along a predetermined path; dye applicator means mounted above said pile fabric web transport means for applying a dye onto said pile fabric web; said dye applicator means comprising a dye holding tray; a dye pickup roll rotatably mounted within said tray to be immersed in dye contained therein whereby during rotation, a layer of dye is coated thereon; a doctor blade mounted adjacent said dye pickup roll for removing said layer of dye therefrom; means defining an extension of said doctor blade defining a plurality of channels whereby said removed layer of dye is divided into separate streams or drippings with each said channel having a distinct discharge point forming a separate dye stream or dripping which will fall by gravity onto the pile fabric web being transported thereunder; the said discharge points being arranged in a pattern lateral to the direction of travel of the pile fabric web onto which color is being applied; interruptor means for blocking the flow of dye through at least one preselected said channel whereby said separate stream of dye or dripping is prevented from being formed at the corresponding discharge point of the said preselected one channel; conduit means mounted adjacent to said plurality of channels for selectively discharging a different dye in proximity with the discharge point of said channels to cause a stream or dripping of the different dye or color to fall by gravity onto the pile fabric web being transported thereunder in substantially the same area thereof as a separate stream or dripping being discharged from the discharge point of the said one preselected channel would fall were said one preselected channel not blocked by said interruptor means.

2. The apparatus in accordance with claim 1 and further comprising, in combination, V-shaped channels formed integral with said doctor blade; dye stream interruptor elements mounted below and adjacent said discharge end of said channels and dye stream interrupting comb elements mounted below said dye stream interruptor elements.

3. The apparatus in accordance with claim 1 and further comprising means for applying a thick viscous layer of a watersoluble natural or synthetic gum to the pile face of said pile fabric web, said means for applying said viscous layer being positioned upstream of the said dye applicator units so that said viscous layer is applied prior to the application of said dyes.

4. The apparatus in accordance with claim 3 and further comprising means upstream from said means for applying said thick viscous layer for background dyeing the carpet pile and for washing the web following said background dyeing prior to the delivery of said web to said means for applying said thick viscous gum.

5. The apparatus of claim 3, wherein said means for applying said thick coating layer comprising a coating trough, a coating material pick-up roll projecting into said trough, a doctor blade adjacent the pickup roll for removing a layer of coating material therefrom and delivering it onto said pile face of the moving web, and a web levelling roll near and below said doctor blade directing said web into a horizontal path of movement downstream from coating trough.

6. The apparatus of claim 5, and additional means upstream from said means to apply said thick viscous layer for background dyeing the pile and for washing the web following said background dyeing prior to the delivery of the web to said means for applying said thick viscous coating layer.

* * * * *